US007044575B2

(12) United States Patent
Kelley et al.

(10) Patent No.: US 7,044,575 B2
(45) **Date of Patent: *May 16, 2006**

(54) PEN TO PAPER SPACING FOR INKJET PRINTING

(75) Inventors: Richard A. Kelley, Vancouver, WA (US); Wade A. Powell, Vancouver, WA (US); David E. DeBellis, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 14 days.

This patent is subject to a terminal disclaimer.

(21) Appl. No.: 10/618,903

(22) Filed: Jul. 14, 2003

(65) Prior Publication Data

US 2004/0017418 A1 Jan. 29, 2004

Related U.S. Application Data

(63) Continuation of application No. 10/194,558, filed on Jul. 12, 2002, now Pat. No. 6,666,537.

(51) Int. Cl.
*B41J 29/393* (2006.01)

(52) U.S. Cl. ..... 347/19; 347/8; 347/16

(58) Field of Classification Search ..... 347/8, 347/19, 14, 5, 58, 11, 12, 10, 23, 16, 101, 347/104, 105; 400/59
See application file for complete search history.

(56) References Cited

U.S. PATENT DOCUMENTS 6,273,536 B1 * 8/2001 Nozawa ..... 347/8
6,406,110 B1 * 6/2002 Ahne et al. ..... 347/8
6,629,787 B1 * 10/2003 Lee et al. ..... 400/59
6,666,537 B1 * 12/2003 Kelley et al. ..... 347/8

* cited by examiner

*Primary Examiner*—Hai Pham
*Assistant Examiner*—Lam Nguyen

(57) ABSTRACT

In a print system including a host communicating with an inkjet print apparatus, a processor executes an inkjet print driver. The driver manages print job communication to the inkjet print apparatus. The print job includes print data and at least one print control parameter. The inkjet print apparatus includes a controller, an inkjet print source which records the print data onto a media, and a mechanism which adjusts source-to-media spacing. The controller responds to a first parameter of the at least one print control parameter to control setting of the source-to-media spacing by the adjusting mechanism for the print job.

22 Claims, 6 Drawing Sheets

PEN TO PAPER SPACING FOR INKJET PRINTING

The application is a Continuation of U.S. application Ser. No. 10/194,558, filed Jul. 12, 2002; now U.S. Pat. No. 6,666,537, the specification of which is incorporated herein by reference.

BACKGROUND OF THE INVENTION

The present invention relates generally to inkjet printing, and more particularly to controlling pen to paper spacing within an inkjet printing apparatus.

An inkjet printing apparatus is a type of non-impact printing device that forms characters, symbols, graphics or other images by controllably spraying drops of ink. The apparatus typically includes a cartridge, often called a "pen," which houses a printhead. The printhead has very small nozzles through which the ink drops are ejected. To print an image the pen is propelled back and forth across a media sheet, while the ink drops are ejected from the printhead in a controlled pattern.

An inkjet printing apparatus may be employed in a variety of devices, such as printers, plotters, scanners, facsimile machines, copiers, and the like. There are various forms of inkjet printheads, known to those skilled in the art, including, for example, thermal inkjet printheads and piezoelectric printheads. Two earlier thermal inkjet ejection mechanisms are shown in U.S. Pat. Nos. 5,278,584 and 4,683,481, currently assigned to the present assignee, The Hewlett-Packard Company of Palo Alto, Calif. In a thermal inkjet printing system, ink flows along ink channels from a reservoir into an array of vaporization chambers. Associated with each chamber are a heating element and a nozzle. A respective heating element is energized to heat ink contained within the corresponding chamber. The corresponding nozzle forms an ejection outlet for the heated ink. As the pen moves across the page, the heating elements are selectively energized causing ink drops to be expelled in a controlled pattern. The ink drops dry on the page shortly after deposition to form a desired image (e.g., text, chart, graphic or other image).

Pen to paper spacing ('PPS') is the average normal distance from an outer surface of the printhead to the paper within the print zone. In an inkjet printing apparatus, the ink typically includes a relatively large amount of water. As the wet ink contacts the paper, the water in the ink saturates the paper fibers, causing the fibers to expand, which in turn causes the paper to buckle. Such buckling action also is referred to as cockling. Cockling of the paper tends to cause the paper to bend in an uncontrolled manner downward away from the printhead and upward toward the printhead. Cockling varies the pen to paper spacing ('PPS'), which reduces print quality. In the extreme an upwardly buckling page contacts a pen nozzle causing ink to smear on the paper. In a worst case scenario an upwardly buckling page in contact with a nozzle damages the nozzle.

SUMMARY OF THE INVENTION

According to one aspect of the present invention, in a print system including a host communicating with an inkjet print apparatus, a processor executes an inkjet print driver. The driver manages print job communication to the inkjet print apparatus. The print job includes print data and at least one print control parameter. The inkjet print apparatus includes a controller, an inkjet print source that records the print data onto a media, and a mechanism which adjusts source-to-media spacing. The controller responds to a first parameter of the at least one print control parameter to control setting of the source-to-media spacing by the adjusting mechanism for the print job.

DETAILED DESCRIPTION OF A PREFERRED EMBODIMENT

Figure 1:
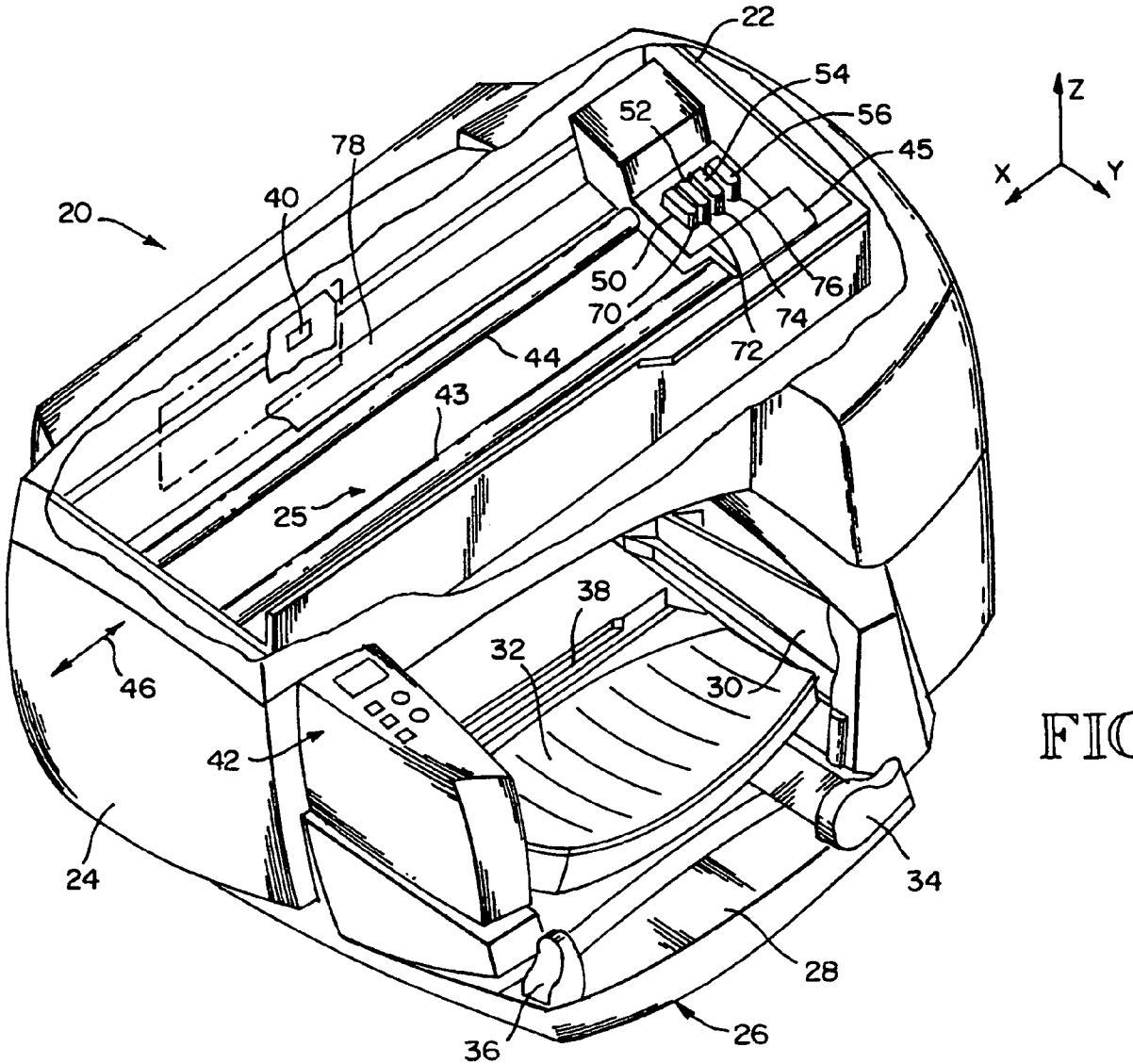
FIG. 1 is a perspective view of one form of an inkjet print apparatus, here, an inkjet printer.

FIG. 1 illustrates an inkjet printing apparatus, here shown as an inkjet printer 20. Such apparatus may be used for printing business reports, printing correspondence, and performing desktop publishing, and the like, in an industrial, office, home or other environment. A variety of inkjet printing apparatuses are commercially available. For instance, some of the printing apparatuses that may embody the present invention include portable printing units, copiers, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a print-zone 25 by a media handling system 26. The print media may be any type of suitable sheet material, supplied in individual sheets or fed from a roll, such as paper, cardstock, transparencies, photographic paper, fabric, Mylar, and the like. For convenience, the illustrated embodiment is described using a media sheet as the print medium. The media handling system 26 has a feed tray 28 for storing media sheets before printing. A series of conventional drive rollers driven by a stepper motor and drive gear assembly may be used to move the media sheet from the input supply tray 28, through the print-zone 25, and after printing, onto a pair of extended output drying wing members 30, shown in a retracted or rest position in FIG. 1. The wings 30 momentarily hold a newly printed sheet above any previously printed sheets still drying in an output tray portion 32. The wings 30 then retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a keypad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slidably support an inkjet pen carriage system 45 for travel back and forth across the print-zone 25 along a scanning axis 46. In some embodiments an anti-rotation rod 43 also is included. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the print-zone 25, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

In the print-zone 25, the media sheet (not shown) receives ink from an inkjet cartridge, such as a black ink cartridge 50 and three monochrome color ink cartridges 52, 54 and 56, shown schematically in FIG. 1. The cartridges 50–56 are often called "pens" by those in the art. The black ink pen 50 typically contain a pigment-based ink, while the color pens 52–56 each typically contain a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include reservoirs for storing a supply of ink. Systems where the main ink supply is stored locally within the pen for a replaceable inkjet cartridge system are referred to as an "on-axis" system. Systems which store the main ink supply at a stationary location remote from the print-zone scanning axis are called "off-axis" systems.

The printheads 70, 72, 74 and 76 each have an orifice plate with a plurality of nozzles formed there through in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the print-zone 25 under the nozzle. The printhead resistors are selectively energized in response to firing command control signals delivered by a multi-conductor strip 78 from the controller 40 to the printhead carriage 45.

Figure 2:
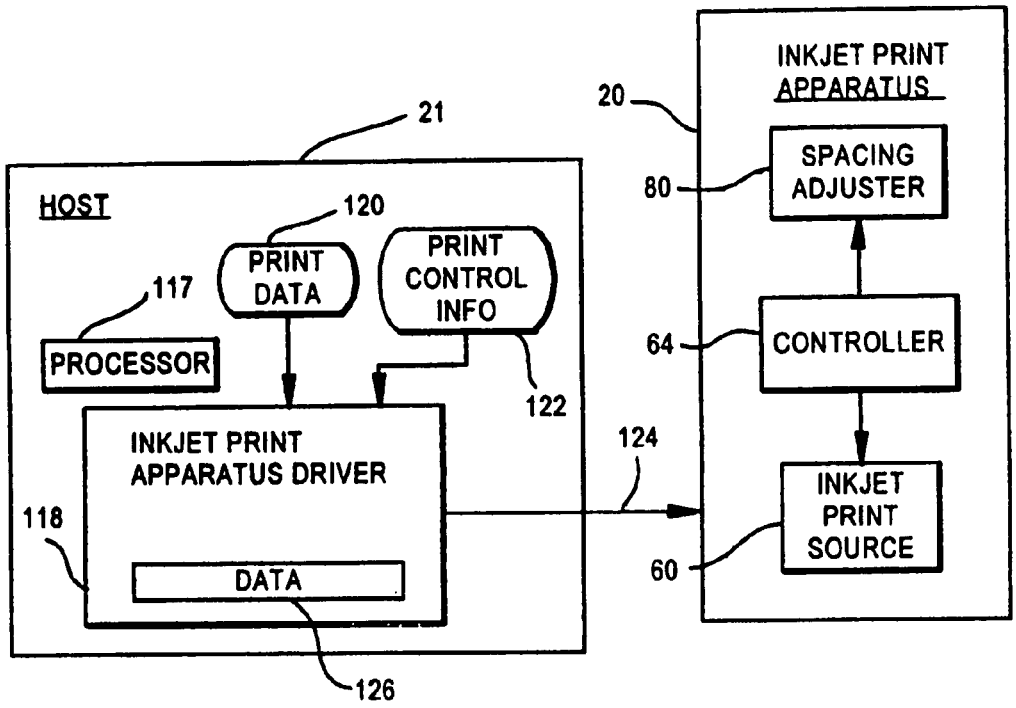
FIG. 2 is a block diagram of a host system in combination with an inkjet print apparatus.

Referring to FIG. 2, a print job is generated by a host 21 for output to the inkjet print apparatus 20. The host 21 is a print data generating source such as a general purpose microcomputer, a computing device or a microprocessor. The host 21 includes a processor 117 which executes program instructions. The processor executes an inkjet print apparatus driver program 118 which manages print job communication with the inkjet print apparatus 20. The host 21 generates print data 120 and print control information 122 which is input to the print driver 118. For a host computing system, a user typically commands that a file or other unit of data be printed. Associated with the print data 120 a media type on which the data is to be printed. For example, an application program allows a user to select the media type for a document to be printed. Exemplary media types include, but are not limited to: glossy paper, non-glossy paper, postcard stock, envelope stock, and transparency. The media type is included as part of the print control information 122. The driver 118 generates a print job 124 which includes the print data 120 and print control information 122 and sends the print job 124 to the inkjet print apparatus 20.

The inkjet print apparatus 20 includes an inkjet print source 60, a controller 64 and a spacing adjusted 80. The inkjet print source 60 includes one or more inkjet pens 50–56 (see FIG. 1). The controller 64 is formed by a microprocessor or another digital logic device. In some embodiments the controller 40 (see FIG. 1) embodies the controller 64. The spacing adjuster 80 adjusts the spacing between the inkjet print source 60 and a media support 69. The media support 69 carries a media sheet 66. As the media sheet 66 moves through the print zone 25, the inkjet print source 60 ejects ink onto the portion of the media sheet within the print zone 25. The spacing between a printhead of the inkjet print source 60 and the media surface 65 is the pen-to-paper spacing. More specifically, the pen to paper spacing ('PPS') is the average normal distance from an outer surface of the printhead to the media sheet within the print zone.

Figure 3:
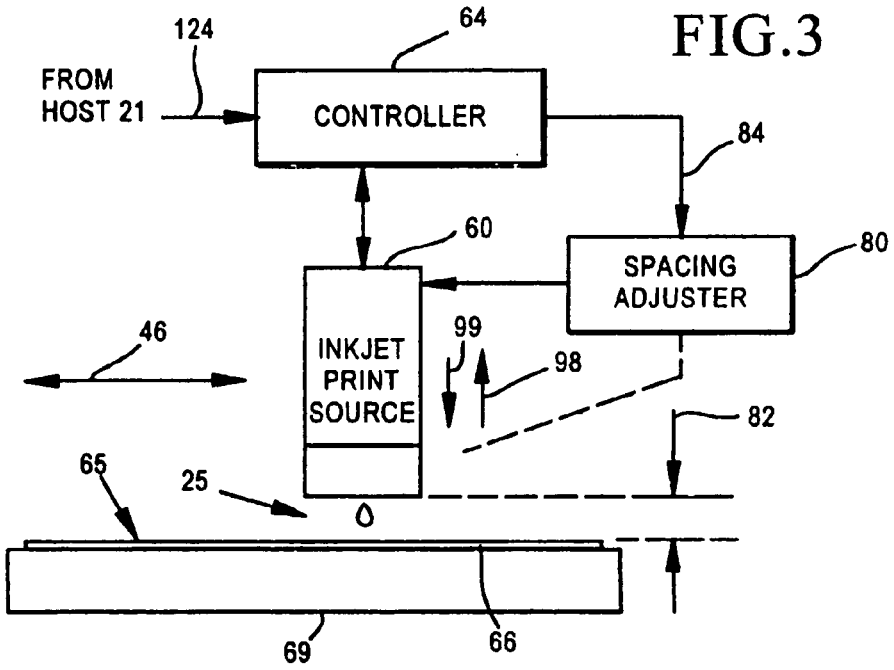
FIG. 3 is a schematic diagram of an inkjet print apparatus with pen to paper spacing control according to an embodiment of the present invention.

Referring to FIGS. 2–3, in one embodiment, the pen-to-paper spacing 82 is set for a given print job according to the media type commanded for the print job. The media type is controlled by the user and specified to the inkjet print apparatus 20 by the inkjet print apparatus driver 118. Specifically, the media type is included as one parameter among the print control information. In some embodiments the print driver 118 includes a look-up table or other data 126 which associates an appropriate pen-to-paper spacing with the designated media type. The print driver 118 sends the associated PPS value to the inkjet print apparatus 20 as one parameter among the print control information 122. In an alternative embodiment the controller 64 includes the look-up table or data association to determine the appropriate PPS for the designated media type. In either case, the inkjet print apparatus receives a parameter from the inkjet print apparatus driver 118. Based on the received parameter the controller 64 generates a command causing the spacing adjuster 80 to set a pen-to-paper spacing for the print job. In other embodiments, the initial pen-to-paper spacing is set and left alone during the course of the print job. In other embodiments, the pen-to-paper spacing is controlled over the course of the print job to sustain the desired pen-to-paper spacing even as contours in the media surface would vary the PPS. In still other embodiments, the media type is detected by a sensor in the printer, and the controller 64 determines the appropriate pen-to-paper spacing for the sensed media type.

Controlling the pen-to-paper spacing to maintain a generally constant PPS during the print job is described below with regard to FIGS. 4–7. An embodiment where the pen-to-appear space is left alone during the course of the print job is described below with regard to FIGS. 8–9. Detailed descriptions of two spacing adjuster 80 embodiments are described below with regard to FIGS. 6–9.

Controlled PPS During Print Job

Figure 4:
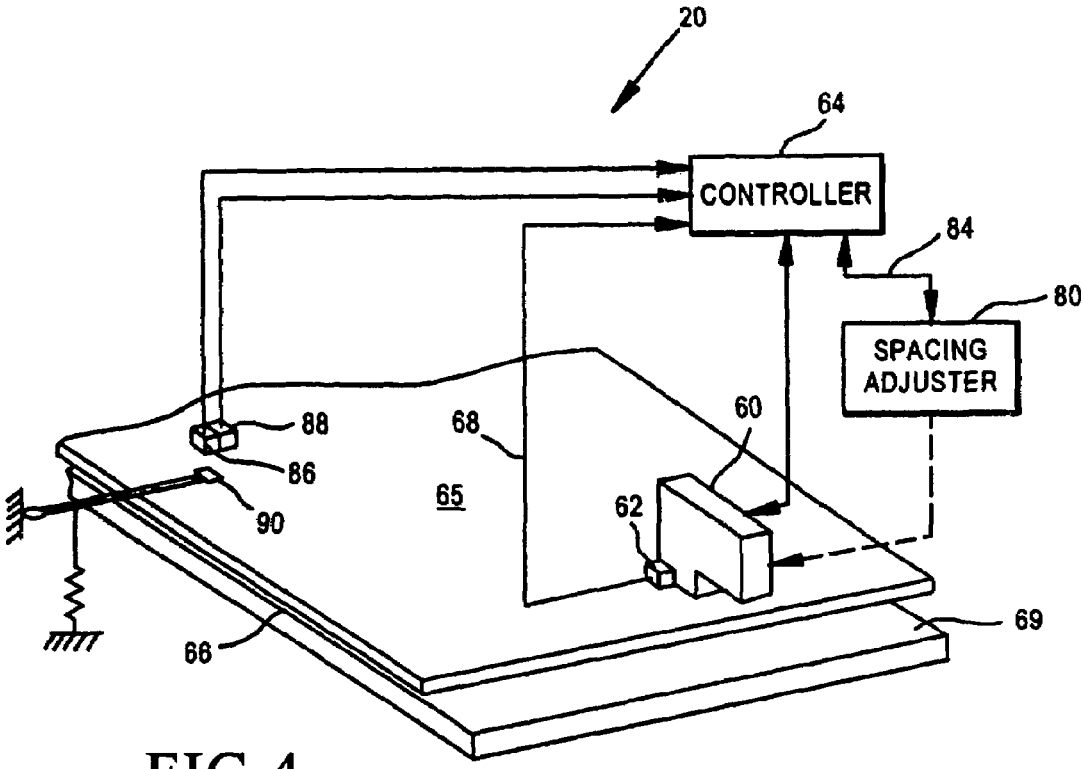
FIG. 4 is a schematic diagram of an inkjet print apparatus with pen to paper spacing control according to another embodiment of the present invention.
Figure 5:
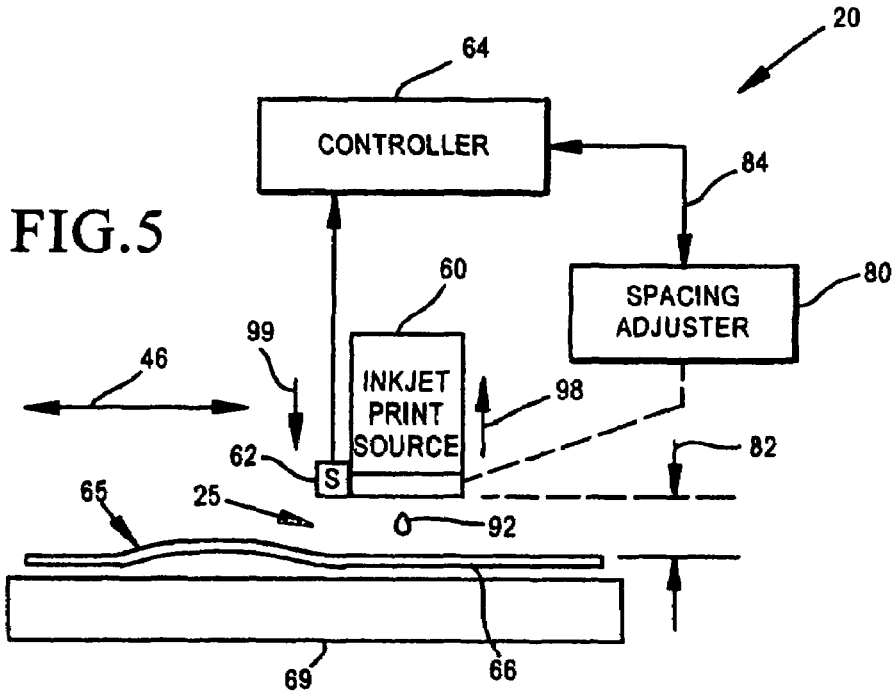
FIG. 5 is a schematic diagram of an inkjet print apparatus with pen to paper spacing control according to another embodiment of the present invention.

Referring to FIG. 4–5, an inkjet print apparatus according to one embodiment of this invention further includes a sensor 62 which detects an underlying media surface 65 of a media sheet 66. In various embodiments, the sensor 62 is an optical sensor, acoustic sensor, mechanical sensor or another type of sensing device or sensing mechanism. The sensor 62 generates an output 68 coupled to the controller 64. The output 68 is used by the controller 64 to control spacing 82 between the inkjet print source 60 and the media surface 65. The controller 64 outputs a signal 84 to the spacing adjuster 80 causing the inkjet print source height relative to the support 69 to be adjusted. Specifically, the height is adjusted so that the PPS is maintained even as the media surface bows or cockles or otherwise curves. The adjuster 80 varies the inkjet print source height between a minimum and a maximum height. The adjuster 80 moves the inkjet print source 60 in a direction 98 away from a media support 69 to increase the inkjet print source height. The mechanism 80 moves the inkjet print source 60 in a direction 99 toward from a media support 69 to decrease the inkjet print source height.

In some embodiments the sensor 62 output may vary according to the type of media. For example, an optical sensor may detect a glossy media sheet to be slightly closer to the pen 60 than a non-glossy media sheet, even though the two sheets are of the same thickness and have an upper surface at the same actual distance from the print source 60. To avoid such discrepancies, some embodiments include calibration devices. For example, referring again to FIG. 2, a pair of calibration sensors 86, 88 and a target 90, may be included. Preferably, the target 90 is not part of the media sheet 66. The target 90 is biased into contact with the media surface 65. A first calibration sensor 86 detects a distance to the target 90. A second calibration sensor 88 detects a distance to the media surface 65. Each sensor 86, 88 generates an output to the controller 64 which compares the sensed distances. The difference is used as a calibration parameter to adjust the sensor 62 output 68. Preferably, the portion of the media surface 65 sensed by the second calibration sensor 88 is generally adjacent to the target 90. In other embodiments, the sensed portion of the media sheet is located away from the target. The closer the sensed portion to the target 90, however, the more accurate that the calibration parameter is likely to be. In one embodiment the sensor 62 serves as the second calibration sensor 88. In another embodiment, the sensor 62 serves as both the first and second calibration sensors 86, 88. In such embodiment, the target 90 is moved into position for sensing, and moved out of position so the underlying media surface can be sensed. The media sheet 66 may be stationary or moving during these calibration processes.

Referring to FIGS. 1 and 4–6, a carriage 45 carries the inkjet print source 60 (e.g., sources 50–56) to slew the sources across the media surface 65. The carriage slews back and forth across the media surface as the inkjet print sources 50–56 eject ink droplets 92 onto the media sheet 66. The carriage 45 (see FIG. 6) includes slots 90–96 for carrying the respective inkjet print sources 50–56. In one embodiment the sensor 62 is carried with the carriage 45 as the carriage slews across the media sheet 66. For example, the sensor 62 may be mounted to the carriage 45 in the vicinity of the openings 90–96. In some embodiments multiple sensors 62 are included. For example, in one embodiment two sensors (not illustrated) are included—one at each end of the inkjet print sources 50–56 along the slewing direction. In still another embodiment 4 or 5 sensors are included so that there is a sensor 62 to each side of each inkjet print source 50–56. One or more of the sensors are active during a given slew. For the two sensor embodiment described, one sensor is active for a given slewing direction. Specifically, the active sensor leads the inkjet print sources 50–56 as the carriage slews across the media sheet. Alternatively, both sensors 62 are active and an average distance is computed from the two sensings.

In the embodiment including one sensor 62, the sensor 62 preferably is mounted adjacent to any of the inkjet print sources 50–56. Although a single sensor 62 is illustrated as being adjacent to an outermost inkjet print source, the sensor 62 alternatively may be positioned between the inner two inkjet print sources 52, 54 or between any other two print sources 50–56.

During operation, the sensor 62 senses the underlying media surface 65 and outputs signal 68 to the controller 64. The controller 64 in turn generates an output signal 84 based on the sensing of the media surface 65 to sustain the commanded PPS for the current print job. The signal 68 may correspond to a distance from the sensor 62 to the underlying media surface 65. The controller uses this distance to estimate a measured pen-to-paper spacing 82. Such estimate in some embodiments is a distance corresponding to the sensed value. In other embodiments, a calibration parameter (as described above) is used to correct the sensed value. In still other embodiments the controller 64 uses an algorithm to estimate the pen to-paper spacing 82 based on the current sensing and a prior history of sensed pen-to-paper spacings.

To achieve increased print quality, the media surface 65 is sensed multiple times during a given slew across the media sheet 66. In turn the controller 64 derives an output signal 84 to adjust the pen-to-paper spacing multiple times during the given slew across the media sheet 66. This has the advantage of accurately compensating for variations in the contour of the media surface 65. When the sensor 62 leads the source 60 during a given slew, the pen-to-paper spacing 82 is controlled to account even for the media cockle. This results in increased print quality because the pen-to-paper spacing is maintained generally constant. Further, the media is unlikely to strike the inkjet print source 60 because the pen-to-paper adjuster 80 moves the source 60 in a direction 98 (see FIG. 5) as the sensor 62 detects the encroaching media surface 65. Thereafter, when the contour returns toward a flat contour and the sensor 62 detects the distancing media surface 65, the pen-to-paper adjuster 80 moves the source 60 in a direction 99. The effect is to maintain a generally constant pen-to-paper spacing between the source 60 and the underlying portion of the media surface 65 within the print zone 25.

The print zone 25 is the portion of the media surface underlying the combined printhead surfaces of the inkjet print sources 50–56. The sensor 62 senses the media surface within the vicinity of the print zone. By "within the vicinity of the print zone", it is meant within the print zone 25, adjacent to the print zone 25 or within a short distance (e.g., within 2–3 printhead widths of the print zone 25).

Figure 6:
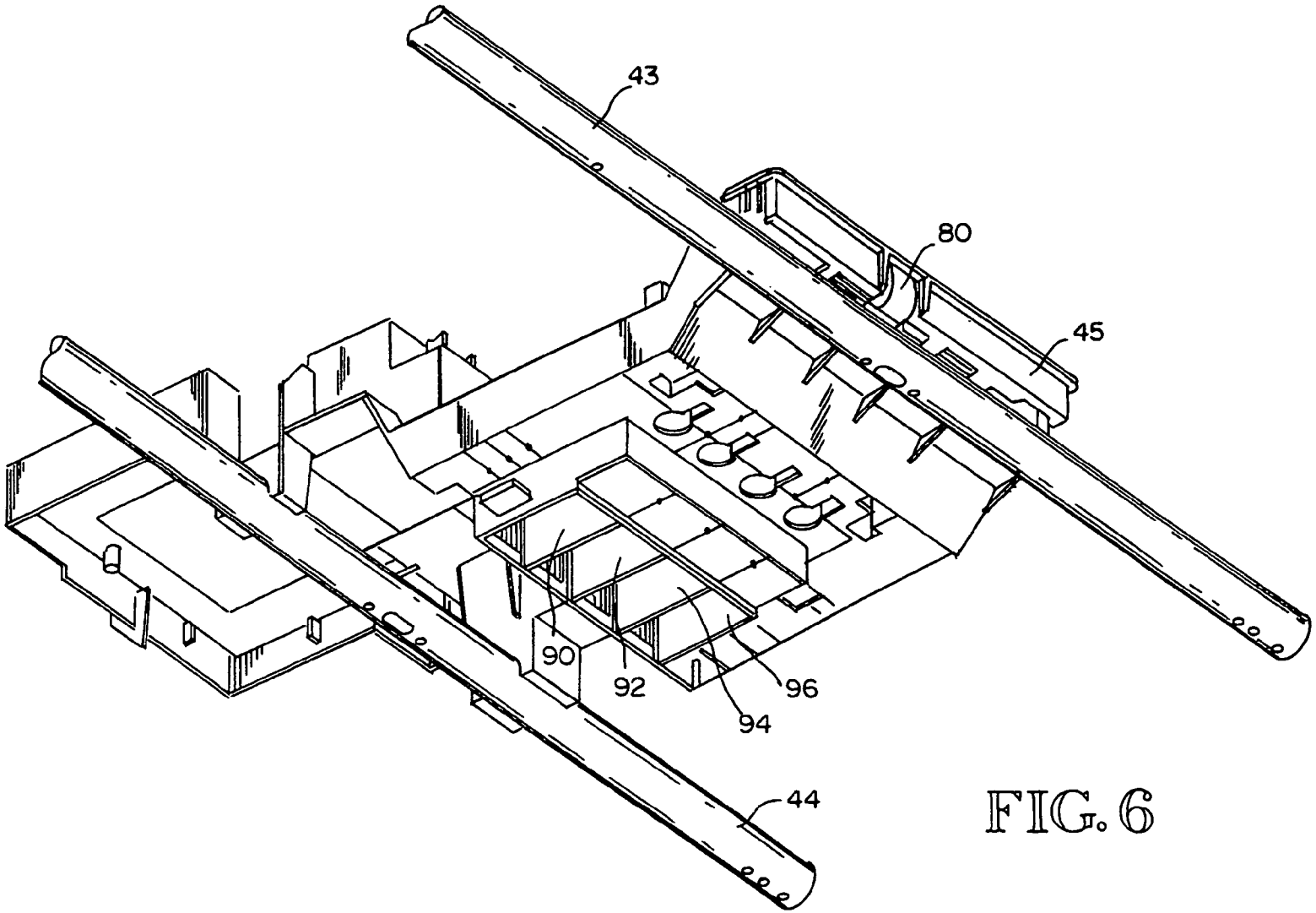
FIG. 6 is a perspective view of a carriage assembly which scans a media sheet.
Figure 7:
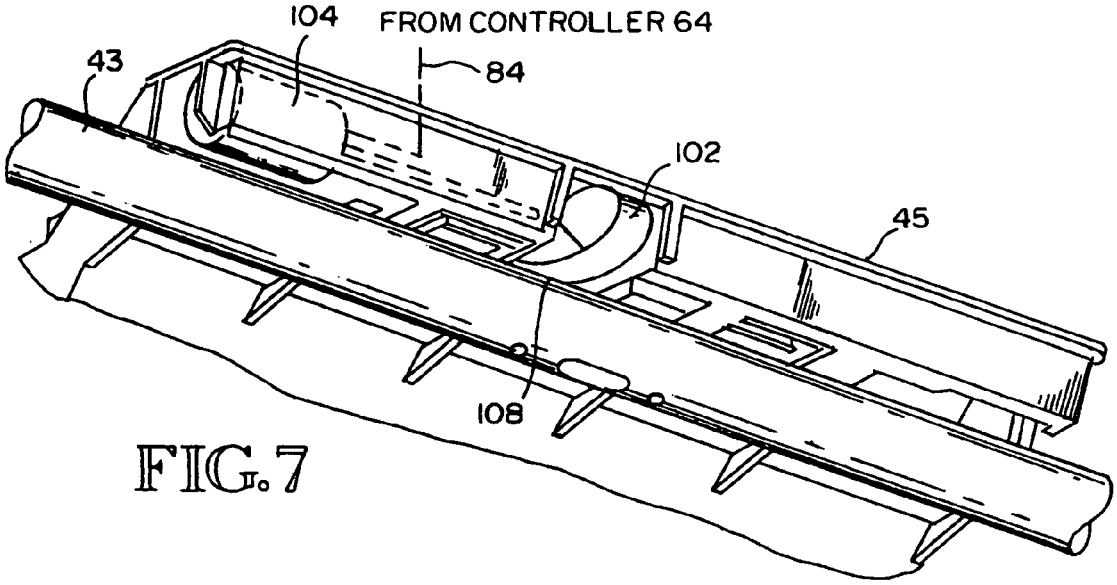
FIG. 7 is a partial perspective view of a portion of the carriage of FIG. 6, including a spacing adjuster according to one embodiment of the invention.

Referring to FIGS. 6–7 the spacing adjuster 80 includes a cam 102 driven by a motor 104. The motor 104 receives the output signal 84 from the controller 64 (of FIGS. 4–5). The motor 104 rotates the cam 102. The cam 102 has a curved surface with a varying distance from a cam axis 106 (see FIG. 7). As the cam 102 rotates, the distance varies from the cam axis 106 to the portion of the cam outer surface 108 which is in contact with the rod 43. Accordingly, the carriage 45 moves either toward or away from the rod 43 as the cam 102 rotates. Such carriage movement in turn moves the inkjet print sources 60 either toward or away from the media support 69 (see FIG. 4–5) in direction 99 or 98 to adjust the height of the source 60 relative to the support 69—and either set or maintain the pen-to-paper spacing 82.

A desired pen-to-paper spacing for a given print job is set by rotating the cam 102 to achieve the appropriate PPS for the designated media type. In some embodiments the cam 102 is held steady thereafter during the print job. In such embodiment the PPS is set and left alone. In other embodiments the cam 102 is adjusted during the print job to maintain the desired PPS compensating for variations in media contour (e.g., during a slew operation).

Alternative Embodiment

Figure 8:
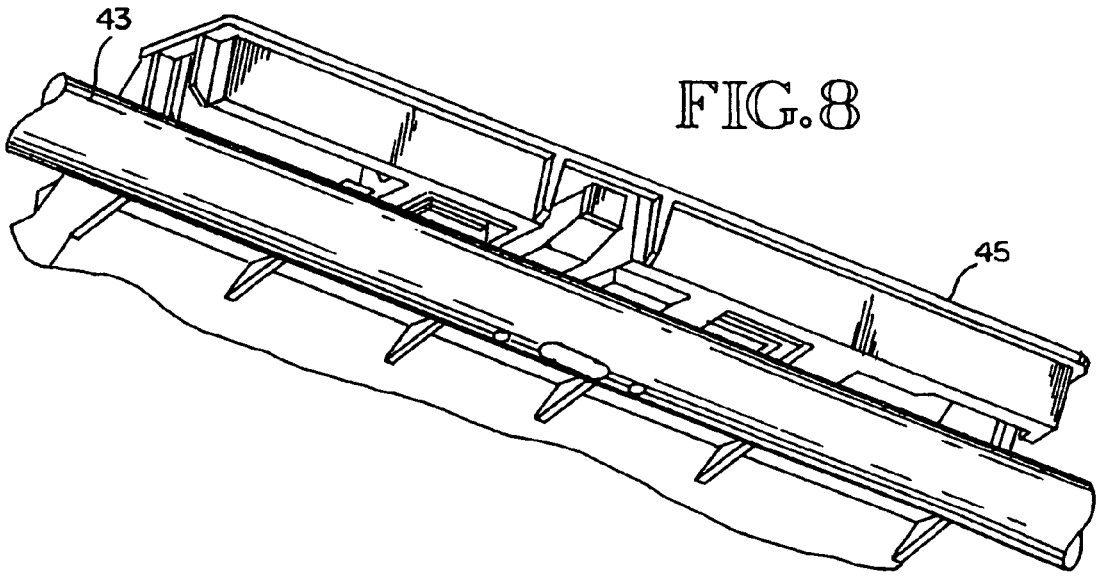
FIG. 8 is a partial perspective view of a portion of the carriage of FIG. 6, including a spacing adjuster according to another embodiment of the invention.
Figure 9:
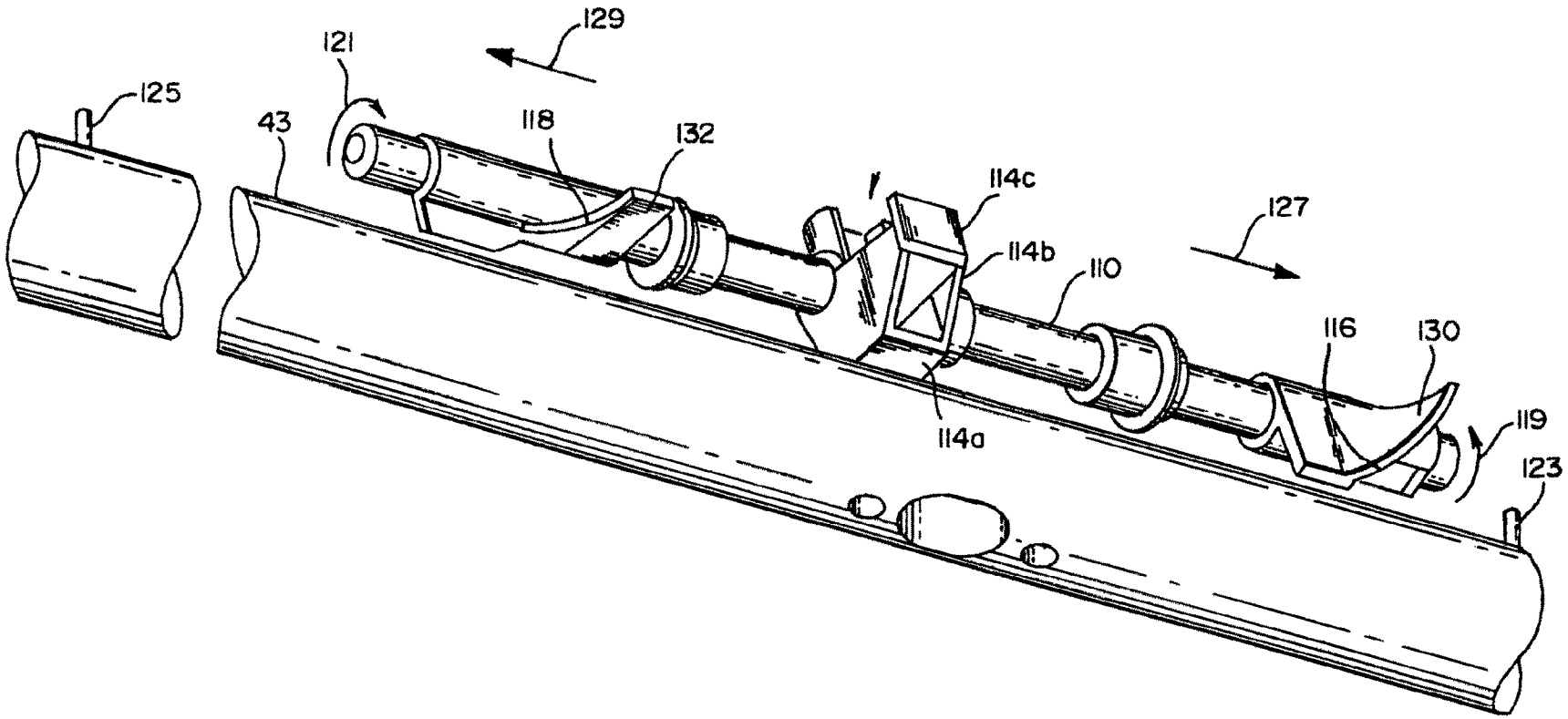
FIG. 9 is a partial perspective view of the spacing adjusted of FIG. 8.

For embodiments where the initial PPS is set and left alone during the print job, FIGS. 6, 8 and 9 illustrate an alternative spacing adjuster 80. Referring to FIGS. 1–3, 6 and 8–9, the spacing adjuster 80 includes an axle 110 to which are coupled a cam 112, a first engagement surface 116 and a second engagement surface 118. The axle 110 is mounted to the carriage 45 and moves with the carriage along the rods 43, 44. The cam 112 includes a plurality of discrete faces 114. Each face is at a different distance from the center of the axle 110. One of the faces 114 is held in place against the rod 43 during a given print job. The face held in place is said to be active and is associated with a specific pen-to-paper spacing. In the illustrated embodiment the cam 112 includes three faces 114*a*, 114*b*, 114*c*, although additional faces are included in alternative embodiments. Preferably, two or more faces are included. In one embodiment these three faces 114*a*–*c* correspond to three alternative pen-to-paper spacings. For example, one PPS may be used for non-cockling media, another for cockling media and the third for envelopes and cardstock. Note that the PPS for non-cockling media can be set to a smaller value than for cockling media because the media surface 65 is less likely to have contours produced by the wet ink.

Referring to FIGS. 3, 8 and 9, when a print job is received the controller 64 responds to a received parameter to control the pen-to-paper spacing. The controller 64 determines which face 114 corresponds to the commanded PPS and is to be made active. To get the desired face as the active face, the axle 110 is to be rotated in either direction 119 or direction 121 (see FIG. 9). The controller 64 knows the current face and knows the desired face. Based on such information the controller 64 determines which direction to rotate the axle 110.

In one embodiment, rotation in direction 119 returns the cam 112 to a first face 114*a*. To achieve the desired rotation the carriage 45 is moved along the carriage rods 43, 44 toward an appropriate end of the carriage rods. If the carriage moves in direction 127, the carriage 45 moves toward a pin 123 protruding from the rod 43. Contact with pin 123 causes the axle 110 to rotate in direction 119. If the carriage moves in the other direction 129, the carriage 45 moves toward a pin 125 protruding from the rod 43. Contact with pin 125 causes the axle 110 to rotate in direction 121.

When the carriage moves to pin 123, the engagement surface 116 contacts the pin 123. The engagement surface 116 is contoured. As the carriage 45 moves in direction 127, the pin 123 engages surface 116 causing the axle 110 to rotate in direction 119. The engagement surface 116 terminates in a dwell section 130. While the pin traverses the dwell section 130 the axle 110 does not rotate further. In one embodiment the controller 64 controls the carriage movement to move in direction 127 to a distance which causes the engagement surface 116 to contact the pin 123 at the dwell section 130. In another embodiment the controller 64 commands the carriage to move in the direction 127 to a fixed end stop. At the end stop the engagement surface 116 contacts the pin 123 at the dwell section 130.

When the carriage moves in direction 129, the carriage 45 moves toward a pin 125 protruding from the rod 43. When the carriage moves to pin 125, the engagement surface 118 contacts the pin 125. The engagement surface 118 is contoured. As the carriage 45 moves in direction 129, the pin 125 engages surface 118 causing the axle 110 to rotate in direction 121. The engagement surface 118 includes a plurality of dwell sections 132. While the pin 125 traverses a dwell section 132 the axle 110 does not rotate further. The controller 64 controls the carriage movement to move in direction 129 to a distance which causes the engagement surface 118 to contact the pin 125 at a desired one of these dwell sections 132. For each dwell section 132 there is a corresponding cam face 114. When a specific dwell section is contacting the pin 125 the corresponding face 114 of the cam 112 is active. When the desired cam face is active, the controller stops moving the carriage in direction 129 and moves it back in direction 127 away from the pin 125. The axle 110 remains motionless when the pins do not cause rotation. Accordingly, the cam 112 remains steady with a desired face 114 set as the active face.

As described for the illustrated embodiment engagement surface 116 has one dwell section 130, while engagement surface 118 has multiple dwell surfaces. Accordingly, rotation of the axle in direction 119, which activates engagement surface 116 causes the cam to return to face 114*a*, while rotation of the axle in direction 121, which activates engagement surface 118 causes the cam to advance to one of faces 114*b* or 114*c*. In an alternative embodiment, both engagement surface 116 and 118 include multiple dwell sections. In such embodiment, rotation of the axle in direction 119, which activates engagement surface 116 allows the cam to stop at an intervening cam face rather than returning all the way to the first cam face 114*a*.

To set the cam 112 to the desired face 114, the carriage 45 is moved toward one of the pins 123, 125. In some cases the carriage is moved first toward pin 123 to return the cam to face 114*a*, then to pin 125 to advance the cam to face 114*b* (or 114*c*). Which pin(s) is to be approached depends on which direction(s) the cam is to be rotated to get to the desired face 114. Note that the procedure for rotating the cam is performed prior to a print job, and that the desired cam face 114 is held in place during the print job. Accordingly, the pins 123, 125 are positioned toward the end of the rod 43, so as not to inadvertently rotate the cam 112 during printing.

Although preferred embodiments of the invention have been illustrated and described, various alternatives, modifications and equivalents may be used. Therefore, the foregoing description should not be taken as limiting the scope of the inventions which are defined by the appended claims.

What is claimed is:

1. An inkjet printing apparatus having an adjustable source-to-media spacing, comprising;

a sensor which senses a target which is not part of the media with the sensor, the target being biased into contact with a media surface and which senses the media surface with the sensor;

a comparator for comparing the sensed target with the sensed media surface to derive a calibration parameter;

a calibrator for calibrating the sensor to account for variations in sensed media surface according to media type;

an inkjet print source which ejects ink onto the media surface within the print zone; and a controller which adjusts the inkjet print source relative to the media to control source-to-media spacing as a function of the sensed media type.

2. An inkjet printing apparatus according to claim 1, further comprising:

a carriage which carries the inkjet print source across the media surface, wherein said sensor senses the media type and the controller adjusts the inkjet print source relative to the media, based on the sensed media type, to control source-to-media spacing as the carriage slews the inkjet print source across the media surface.

3. An inkjet printing apparatus according to claim 2, wherein the sensor moves with the carriage.

4. An inkjet printing apparatus according to claim 2, wherein said controller varies the inkjet print source relative to the media multiple times during a single slew of the carriage across the media to maintain the source-to-media spacing.

5. An inkjet printing apparatus according to claim 1, wherein said controller adjusts a height spacing of the inkjet print source relative to a support carrying the media.

6. An inkjet printing apparatus according to claim 1, further comprising;

wherein the calibrator is provided by a calibration sensor.

7. An inkjet printing apparatus according to claim 6, wherein the calibrator comprises the sensor and a target, wherein the target is not part of the media and is biased into contact with the media surface, at a first time the sensor sensing the target and at a second time the sensor sensing the media surface, and wherein a calibration parameter is derived from a comparison of the sensed target and the calibration-sensed media surface.

8. An inkjet printing apparatus according to claim 1, wherein the sensor is a first operational sensor, and further comprising:

a first calibration sensor, a second calibration sensor and a target, wherein the target is not part of the media and is biased into contact with the media surface, wherein the first calibration sensor senses the target, the second calibration sensor senses the media surface, and wherein a calibration parameter is derived from a comparison of the sensed target and the calibration-sensed media surface.

9. An inkjet printing apparatus according to claim 8, wherein the second calibration sensor is comprised by the first operational sensor.

10. An inkjet printing apparatus according to claim 8, wherein the first calibration sensor and the second calibration sensor are comprised of the first operational sensor.

11. An inkjet printing apparatus according to claim 1, further comprising a cam and a motor, the motor for rotating the cam, the cam mechanically coupled to the inkjet print source, the motor responsive to the controller by altering a height of the inkjet print source relative to a support carrying the media.

12. An inkjet printing method, comprising sensing a media type;

adjusting the inkjet print source relative to the media to control source-to-media spacing as a function of the sensed media type; and ejecting ink with an inkjet print source onto the media surface;

calibrating the sensor to account for variations in sensed media surface according to media type;

sensing a target which is not part of the media with the sensor, the target being biased into contact with the media surface;

sensing the media surface with the sensor; and comparing the sensed target with the sensed media surface to derive a calibration parameter.

13. An inkjet printing method according to claim 12, further comprising:

slewing a carriage across a media, the carriage carrying the inkjet print source, wherein said sensing, adjusting and ejecting occur during said slewing.

14. An inkjet printing method according to claim 13, wherein said sensing comprises sensing with a media sensor which moves with the carriage.

15. An inkjet printing method according to claim 13, wherein said adjusting comprises varying a height of the inkjet print source relative to a support carrying the media multiple times during a single slew of the carriage across the media to maintain the source-to-media spacing.

16. An inkjet printing method according to claim 12, wherein said sensor is a first operational sensor, and wherein said calibrating comprises:

sensing a target which is not part of the media with a first calibration sensor, the target being biased into contact with the media surface;

sensing the media surface with a second calibration sensor; and comparing the sensed target with the sensed media surface to derive a calibration parameter.

17. An inkjet printing method according to claim 12, wherein said sensor is a first sensor, and wherein said calibrating comprises:

sensing a target which is not part of the media with a second sensor, the target being biased into contact with the media surface;

sensing the media surface with the first sensor; and comparing the sensed target with the sensed media surface to derive a calibration parameter.

18. An inkjet printing apparatus having an adjustable source-to-media spacing, comprising:

means for sensing a media type;

means for maintaining a source-to-media spacing generally constant in presence of changes in the sensed media type;

inkjet means for ejecting ink onto the media surface within the print zone, wherein the source-to-media spacing is a nearest distance between the ejecting means and the media surface; and means for calibrating the sensor to account for variations in sensed media surface according to media type;

means for sensing a target which is not part of the media with the sensor, the target being biased into contact with the media surface;

means for sensing the media surface with the sensor; and means for comparing the sensed target with the sensed media surface to derive a calibration parameter.

19. An inkjet printing apparatus according to claim 18, wherein the maintaining means comprises:

means for adjusting a height of the inkjet print source relative to a support carrying the media.

20. An inkjet printing apparatus according to claim 19, wherein said adjusting means varies the height of the inkjet print source relative to a support carrying the media multiple times during a single slew of the carriage across the media to maintain, the source-to-media spacing.

21. An inkjet printing apparatus according to claim 18, further comprising:

means for carrying the ejecting means across the media surface, wherein said sensing means senses the media type and the maintaining means adjusts height of the inkjet print source relative to a support carrying the media to maintain the source-to-media spacing as the carriage slews across the media surface.

22. An inkjet printing apparatus according to claim 18, wherein the sensing means moves with the carrying means.

* * * * *